US006092301A

United States Patent [19]

Komanowsky

[11] Patent Number: 6,092,301

[45] Date of Patent: Jul. 25, 2000

[54] MICROWAVE DRYING OF HIDES UNDER VACUUM IN TANNING EQUIPMENT

[76] Inventor: Michael Komanowsky, 544 Quail Ct., Blue Bell, Pa. 19422

[21] Appl. No.: 09/191,789

[22] Filed: Nov. 13, 1998

[51] Int. Cl.[7] ..... F26B 3/34

[52] U.S. Cl. ..... 34/263; 34/265

[58] Field of Search ..... 34/259, 261, 263, 34/265, 397, 408; 426/574, 578, 646; 524/111, 119

[56] References Cited

U.S. PATENT DOCUMENTS

| | | | |
|---|---|---|---|
| 4,849,232 | 7/1989 | Baker et al. | 426/92 |
| 4,856,201 | 8/1989 | Dokoupil et al. | 34/263 |
| 5,467,694 | 11/1995 | Mochizuki et al. | 34/265 X |
| 5,886,326 | 3/1999 | Tang | 34/263 X |
| 5,956,865 | 9/1999 | Durance et al. | 34/263 |
| 5,962,057 | 10/1999 | Durance et al. | 34/263 X |
| 6,016,862 | 1/2000 | Herreid | 164/525 |

*Primary Examiner*—Stephen Gravini

[57] ABSTRACT

By providing a hide processor or tanning drum with appropriate equipment for applying vacuum and microwave energy concurrently, these tanning machines become a versatile means of drying to yield dry hides that contain no salt yet store better than salted hides. In this novel process, fresh hides are loaded into the tanning machine where they are washed, demanured and then dried in situ under vacuum with concomitant application of microwave energy. Because the dried hides thus obtained are soft and pliable, they can be mechanically fleshed or shaved to remove the subcutaneous tissues rich in collagen and fat. Alternatively, the hides may be first dried in the tanning machine to below 35% moisture content and degreased using a solvent such as hexane. The solvent remaining in the hides after decantation of the unabsorbed liquid is vaporized at low temperature using vacuum and microwave energy. The hides are then dried in situ to the desired final moisture content. By shaving off the subcutaneous tissues of these hides a dry, fat-free, valuable undenatured collagen product is obtained. If the hides are unhaired before drying, they may be shaved and then accurately split. The process is also suitable for removing hair and fat from hide trimmings to obtain a valuable undenatured collagen product and fat. Furthermore, it can be used to remove fat from connective tissues and other animal offal containing no hair yielding a dry undenatured collagen product.

2 Claims, 5 Drawing Sheets

MICROWAVE DRYING OF HIDES UNDER VACUUM IN TANNING EQUIPMENT

BACKGROUND OF THE INVENTION (A). Field of the Invention

This invention relates to a novel process for preserving hides as well as recovering undenatured collagen and high quality fat from collagen raw materials. The aim is processing of hides and skins with a minimum amount of manual labor, with a minimum amount of waste, and maximum utilization of by-products. The process encompasses adaptation of a tanning machine to carry out (in addition to the usual operations of hide preservation and tanning) removal of fat using a solvent, and dehydration by means of vacuum and microwave energy to obtain soft, dry hides or skins that do not require salt for preservation. The hides and skins may be unhaired or even unhaired and tanned, and the leather brought to a dry "crust" condition using vacuum and microwave energy without being taken out of the tanning machine. The same process allows trimmings and other offal to be degreased, unhaired, and dried to yield fat and undenatured collagen, a valuable by-product.

(B). Prior Art

Tanning drums and hide processors are presently used commercially for the manufacture of leather and for salting of hides and skins; however, all operations are carried out at atmospheric pressure. Because of the low temperature of denaturation of hide collagen, drying is carried out in special dryers only after tanning that increases the denaturation temperature.

Salt curing of hides is presently by far the most common method of preservation of cattlehides to protect them from damage by microorganisms. Salt removes a sufficient amount of water from the hide and drops the water activity sufficiently to inhibit the growth of most albeit not all microorganisms that damage the hide during shipment and storage. Conventional salting operations take roughly a week and involve piling hides between layers of salt using up as much as half a pound of salt per lb. of hide.

In the U. S. most of the hides produced at or near large slaughter houses are salted by a process called brine curing in runways to reduce the time necessary for salt to penetrate the hide. This process utilizes saturated salt solutions and is preceded by hide washing, fleshing, demanuring (using a manually fed machine in the latter two steps), and hide trimming (also by hand). Following brine curing in a runway, and feeding the hides (manually) into a wringer, they are inspected, graded, and piled before shipping. During fleshing the subcutaneous tissues (which may contain up to 50% of fat with the rest comprised of mostly collagen) are removed from the flesh side of the hide in order to enhance diffusion of salt and thereby to shorten the hide curing process to 24 hours. Another reason for prefleshing is the fact that during prolonged storage of unfleshed hides fatty acids are formed which penetrate into the hide corium and form calcium soaps that cause uneven tanning and coloring of hides during subsequent leather manufacture. Prefleshing also permits rendering of the fleshings and trimmings by melting and pressing to obtain a salable fat by-product and a low-priced, denatured protein by-product. The latter is of little value since collagen is denatured at the high temperature used during rendering. Because of the high costs involved, presently most of the hides are not washed and prefleshed before salting or brine curing. And since salted hides may be subject to bacterial attack, bactericides are added in addition to the salt. This makes any by-products recovered from them unusable for food or medical use. Besides, the decomposition of the fat during shipment and storage of salted hides before they arrive in the tannery yields a fat of low grade due to its dirty color and to an unpleasant smell, especially if the hides have been in contact with sulfide, a chemical generally used for unhairing of hides in the tannery. Even if the hides are prefleshed before curing, the operation is very often not satisfactory enough for leather manufacture and, therefore, the tanner often repeats the process of grading, trimming, and fleshing.

The practice of salting of hides is thus a very cost and labor intensive operation involving duplication of effort first to put the salt into the hide at the slaughter house and then to take the salt out again in the tannery. Recovery of proteins from trimmings in the tannery is also prohibitive because of its high moisture content; the product obtained is too expensive compared to products obtained by the simple process of dry heating of other offal from the animal body. Being hydrophilic, water interferes with penetration of hydrophobic organic solvents into the wet hide material and thereby limits the use of solvent extraction of fats from hides.

While providing poor preservation of hide protein and fat, and necessitating addition of biocide, present hide preservation practices are wasteful of collagen, a valuable material, in the form of trimmings, fleshings, and shavings that often contain chrome, a potentially hazardous chemical. Yet to date all attempts at finding a more cost effective means to preserve hides while minimizing pollution by salt and chrome has been unsuccessful despite a multitude of research studies inspired by ever stricter environmental restrictions and the increased cost of disposal of salt as well as of hide and leather offal. In addition to being very costly, conventional air drying of hides, the oldest alternative method of hide preservation, causes oxidation of fat and hardens the hide, making it almost impossible to rehydrate to its original condition.

Heretofore methods of solvent extraction of oils and fats from different raw materials have been published (see Badger, W. L. and Banchero, J. T. , "Fundamentals of Chemical Engineering", McGraw-Hill Book Company, Inc., New York (1955), p. 331). Also, microwave drying under vacuum of hides and leather have been described (see U. S. Pat. No. No. 4856201, and publications by Heidemann E., and Komanowsky M. cited on the Title page above). However, neither of these two processes are economically feasible for hides and leather. The former because animal fat is relatively cheap, and because present technology does not provide an ecologically satisfactory removal of the solvent remaining in the hide after solvent degreasing without denaturing hide collagen. The latter mostly because the microwave equipment recommended requires a separate drying step in which the hides or leathers are manually hung on rod shaped supports or laid on a belt or a plate support device. Even though the latter technique utilizes very large treatment chambers (because of the space needed between each hide to expose it evenly to the microwave energy), it does not ensure uniform drying over the whole area. The construction of the equipment is intricate, and its use restricted only to drying. Furthermore, it is not adaptable to drying hide trimmings, fleshings or other animal by-products containing collagen. Also, without mechanical flexing of hides during drying that is achieved by using the method described in this patent, untanned dry hides are not soft and pliable.

SUMMARY OF THE INVENTION

This invention is based on the discovery that drying of hides or hide by-products can be carried out most satisfactorily in a rotating piece of equipment such as a tanning drum with concurrent use of vacuum and microwave energy. The continuous tumbling of the materials being dried ensures uniform drying over the whole area. The use of vacuum allows drying at temperatures low enough to prevent denaturation of the collagen in the material. The use of microwave energy causes evaporation of moisture inside the material "from the inside out" permitting it to retain its porosity. The constant flexing and tumbling action in conjunction with microwave drying yields a flexible, fairly soft, dry product that rehydrates well and can be stored for a very long time. Processing of hides by this method can make the present practice of salting of hides obsolescent.

Depending on whether the flesh (the subcutaneous tissues of the hides) is removed mechanically or by solvent extraction, and depending on the processing stage of hide curing or leather manufacture at which the hide is dried by the method of this invention, different products are obtained such as (a) dry hides with hair and flesh on it, (b) dry hides with the hair on and the flesh removed, (c) dry hides with both the hair and the flesh removed, or (d) "crust leather". If the hide has not been prefleshed, the flesh may be shaved off mechanically because hides dried by the procedure of this invention are sufficiently soft and pliable. However, this operation is greatly facilitated by removing the fat from the flesh by solvent extraction. Shaving then yields dry, undenatured collagen, a valuable product.

According to this invention, hides or partially defatted animal by-products may be first dehydrated under vacuum using microwave energy to remove most of the water (to about 36% moisture content) and to render the hide material accessible to hydrophobic solvents. They are then exposed to a suitable organic solvent to recover fat. The solvent remaining in the hide material can be vaporized under vacuum (as recommended in this patent) because applied heat in the form of microwave energy is absorbed by water (that was intentionally retained in the hide during the first drying step) and heats the drum contents to a boiling temperature higher than the boiling point of the solvent used which in the case of hexane is 5.4° C. The vaporized solvent is recovered by condensation and fat is recovered from the fat-in-solvent solution by evaporation in separate equipment. Final drying to remove additional water (to approximately 20% moisture content) is carried out in situ at drying conditions identical to those used in the first drying operation (to about 36%).

Most types of presently used tanning machinery can be adapted to the processes proposed in this invention. The easiest to adapt are hide processors and tanning drums that are divided into sectors and have a rotating inner drum and a stationary outer drum. Hexane appears to be the most advantageous and safest solvent to use if only because there is a large amount of experience with this material (see Badger, W. L. and Banchero, J. T., "Fundamentals of Chemical Engineering", McGraw-Hill Book Co., Inc., New York (1955), p. 131) in fat and oil extraction albeit not under the conditions proposed in this patent application. It has boiling points of 69° C., 31.6° C., 15.8° C., and 5.4° C. at 760 mm Hg, 200 mm Hg, 100 mm Hg and 60 mm Hg, respectively; whereas water has boiling points of 100° C. at atmospheric pressure(760 mm Hg) and 41.7° C. at 60 mm Hg. It is apparent that if the temperature is kept below 41.7° C. very little water will evaporate while hexane will boil out of the hide at above 5.4° C. After removal of the solvent, the temperature is raised to about 42° C. to finish drying the hide material.

The primary objective of this invention is to increase the market value of hides by improving their quality while avoiding salt curing; and to better utilize hide trimmings, hide fleshings and other by-products of animal origin by rendering them more useful and salable as fat of better grade and as undenatured collagen (that is presently in short supply and expensive) instead of being landfilled.

Another objective of this invention is to provide an improved process capable of minimizing most of the problems inherent in the present technology of hide preservation that generates waste and pollution, and an insufficiently stable product.

The third objective of this innovation is to provide a process which allows manufacture in the same equipment not only of preserved dry hides, dry blue sides and dry finished leather but also of undenatured collagen from hide trimmings, fleshings and other offal with a minimum of manual labor and equipment while eliminating, for example, special dryers.

The most valuable feature of this invention is a novel hide product of superior grade that preserves for a much longer time than salted hide, that rehydrates readily, and is soft and porous because it is dried "from the inside out" with microwave energy under vacuum conditions that ensure low drying temperatures.

An equally important feature of the invention is the fact that hides and other collagen containing materials of animal origin can be dried under vacuum with microwaves in a manner that does not require manual operation and does not suffer the disadvantages of the present state of the art. Manual labor is minimized by carrying out all the process operations in the same tanning machine until the hides are dry and ready for marketing. Tumbling in a tanning machine ensures uniform exposure to microwave energy and utilizes the minimum amount of equipment not already available to the tanner or to the hide processor. The processing is of relatively short duration and, therefore, less capital is tied up in hide inventory. The hides can be readily graded, palleted and shipped. Being soft and porous, they can be easily rewetted in the tannery for further processing into leather. They can even be split to the desired thickness as accurately as leather if hair removal is included as part of the process.

Another very important feature of this invention is the fact that it allows processing of trimmings which are too small and not sufficiently uniform in shape and thickness and, therefore, cannot be economically fleshed and recovered as undenatured collagen and fat of premium quality by presently used technology. Processing of fleshings and other animal by-products to obtain undenatured collagen is presently uneconomical.

The key factor which permits the process innovation of this patent is concurrent use of both vacuum and microwave energy to dehydrate hides and to recover absorbed solvent from hides in a novel fashion inside a tanning machine such as a hide processor or a drum.

DETAILED DESCRIPTION OF THE INVENTION

A. Conventional Leather Making Machinery and Process.

Figure 1:
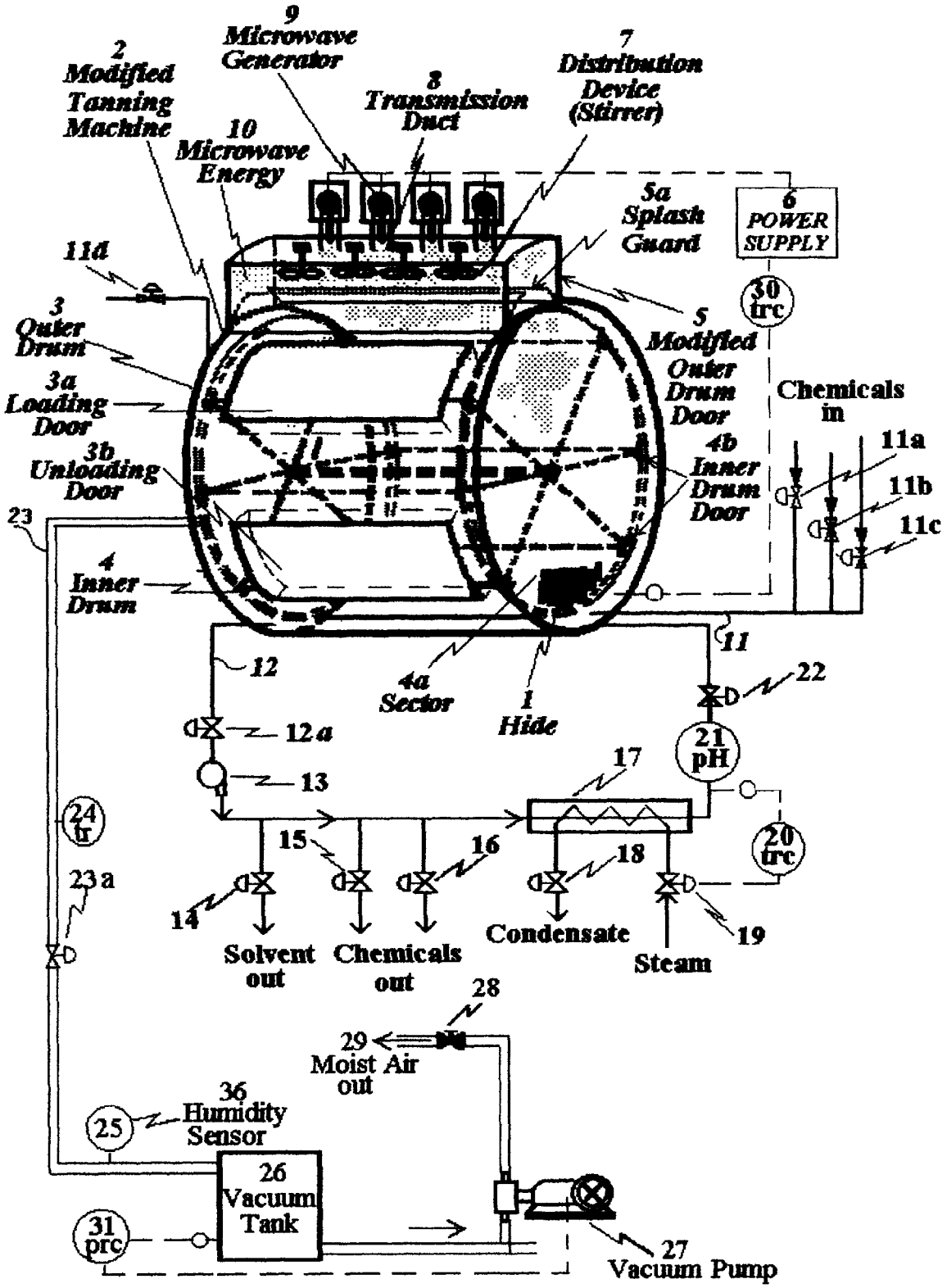
FIG. 1 is a process flow diagram for (a) carrying out the conventional operations used in tanneries, and for (b) drying hides, skins, and other animal by-products by the novel process using microwaves and vacuum concurrently. The figure shows in more detail the side view of a commercial tanning drum that has been modified to permit the use of microwave energy and vacuum. The modified drum is the quintessential piece of equipment of the process FIG. 2 gives a side view of the same tanning drum shown in FIG. 1 that has been modified to permit not only the concurrent use of microwave energy and vacuum for drying but also removal of solvent retained in the product after solvent extraction of fat. As in FIG. 1, the modified drum is the central part of a process flow diagram showing the conventional operations used in tanning, and the novel operations for dehydrating the animal by-products with microwave energy in conjunction with vacuum. In addtion, the process flow diagram in this figure shows the supplementary equipment required for (a) solvent extraction of fat from hides and other animal by-products and (b) recovery of the solvent retained in them after fat extraction by simultaneous use of microwave energy and vacuum.
Figure 2:
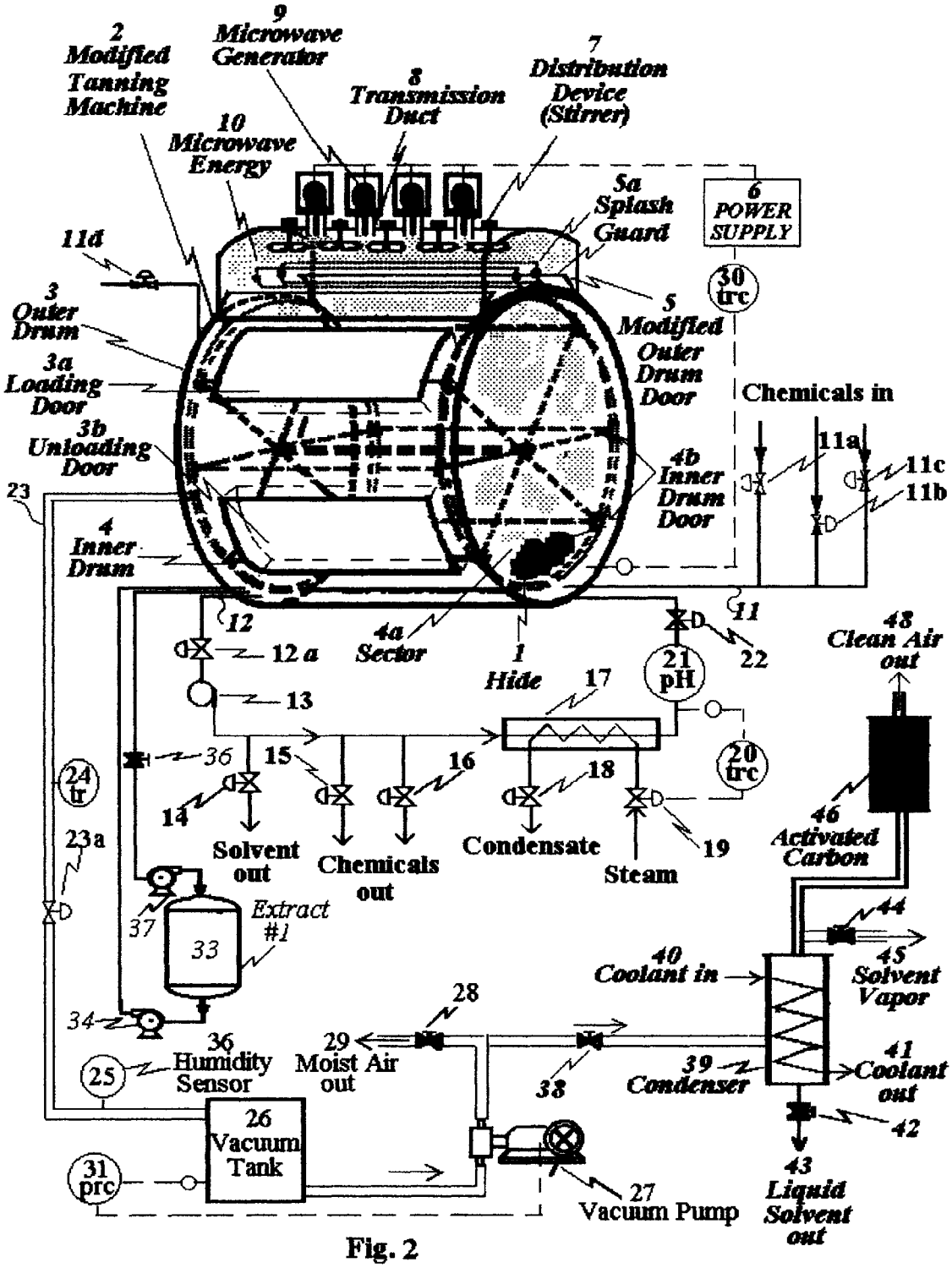

Leather manufacture includes the following operating steps: washing, fleshing, unhairing, neutralizing, bating, tanning, fatliquoring, drying, and finishing. FIGS. 1 and 2 show a side view and FIG. 3 a cross-sectional view, respectively, of a commercial tanning drum (2) consisting of a stationary outer drum (3) with two "doors" or covers (3*a*) and (3*b*) and an inner drum (4) that turns during operation and is comprised of 6 sectors (4*a*). There is a separate door (4*b*) in each sector of the inner drum for loading and unloading of hides. Each door occupies an opening in the tanning drum almost as wide as the inner drum. The doors of each sector of the inner drum are of the same size or somewhat smaller than the doors of the outer drum. Only the inner drum rotates during operation. The hides (1) are loaded through the door (3*a*) near the top of the drum and unloaded through the door (3*b*) near the bottom of the drum. In present commercial practice, door (3*a*) is identical to door (3*b*) and tanning is carried out at atmospheric pressure.

Figure 4:
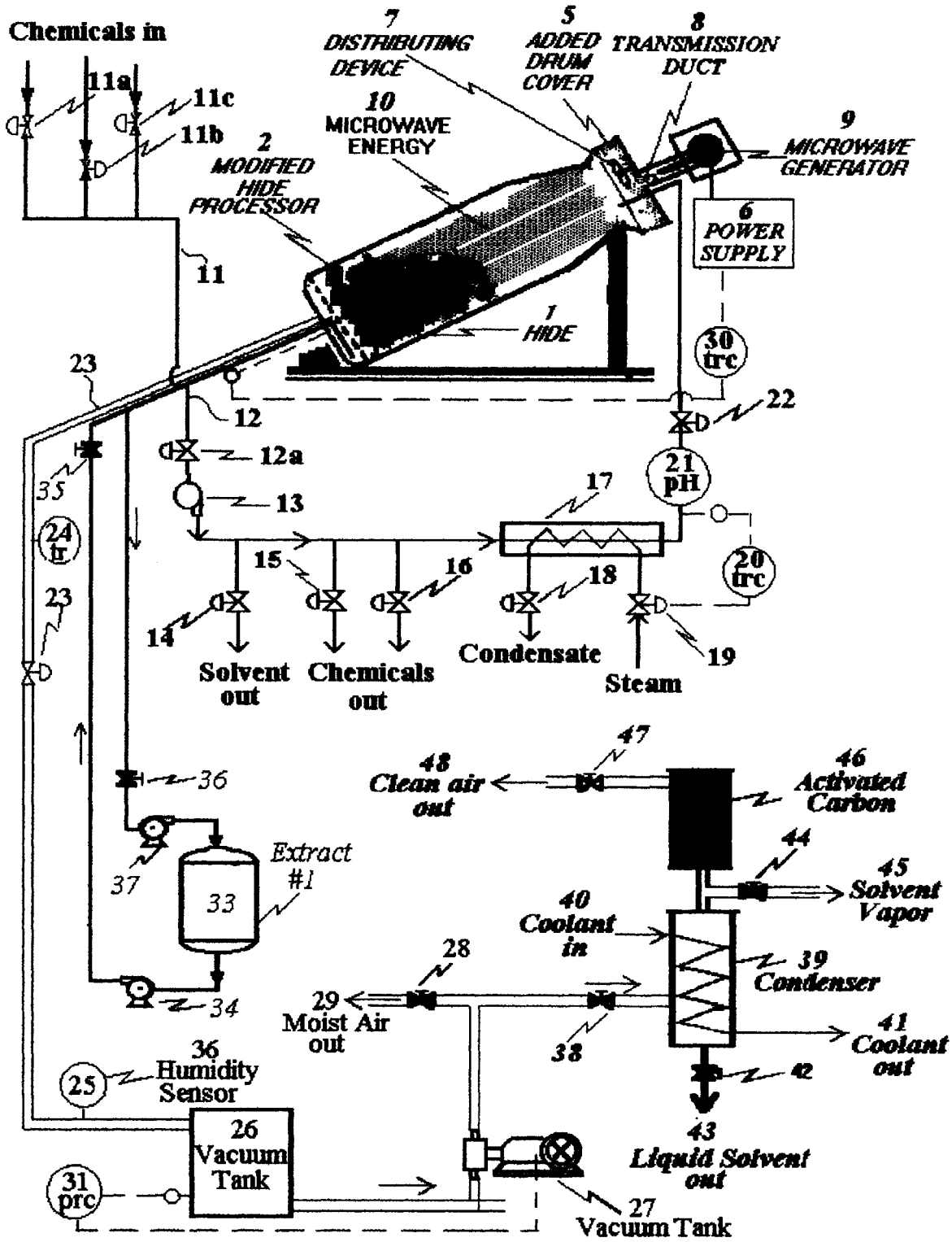
FIG. 4 gives a cross-sectional view of a hide processor that has been modified to permit concomitant use of microwave energy and vacuum to remove both moisture and fat from hides and other animal by-products. As in FIGS. 2 and 3, the hide processor is shown as the basic apparatus in a process flow diagram illustrating the important steps for (a) the conventional operations used in tanneries, (b) dehydrating hides, skins, and animal by-products with microwave energy under vacuum inside the hide processor; (c) solvent extraction of fat and (d) recovery of the solvent retained in the material being defatted utilizing microwave energy and vacuum.

FIG. 4 shows a cross-sectional view of a commercial hide processing machine similar to a "cement mixer" that consists primarily of a vessel (2) and a screw-like spiral (not shown) inside the vessel. Hides (1) are introduced and removed through the top of the processor. During operation, the tanning fluid and the hides in the vessel are mixed as the vessel turns and the spiral lifts the hides up until they fall back to the bottom of the vessel. For better fluid mixing the inside of the vessel is provided with a helical pipe with holes. In present commercial operation the vessel is not covered and tanning is carried out at atmospheric pressure.

As can be seen from FIGS. 1 to 4, typical leather manufacture entails contacting the hides with water and chemical solutions that are introduced into a tanning machine from pipes (11*a*), (11*b*), or (11*c*), depending on the type of solution required, through pipe 11. To keep the desired temperature in the machine, valve (12*a*) is opened and the liquids enter pipe (12) and are recirculated through a heat exchanger (17) by means of pump (13). Temperature control is maintained by means of temperature recorder controller (20) and the pH is adjusted using an in-line pH meter (21). At the end of each operating step of leather manufacture the waste effluent is pumped out through valves (15) or (16) depending on the type of waste effluent and its destination. If processing is limited to salting in present commercial practice, a hide processor is commonly used and the hide is contacted with a concentrated solution of sodium chloride and some biocide. After the salt has thoroughly penetrated the hides, they are removed and piled on pallets. Additional salt is spread on top of each hide to ensure that the water in the hide is completely saturated with salt. Most of the hides marketed are salted and have both hair and flesh on them. None are dried because conventional drying at atmospheric pressure or under vacuum yields a product that cannot be readily rewetted.

B. Modification of Conventional Tanning Machines to Adapt them to Processing Proposed in this Invention.

Drying with microwave energy has the advantage that it occurs "from the inside out" yielding a porous product that readily rehydrates as long as the drying occurs at a pressure low enough to ensure temperature conditions at which collagen does not denature. Another benefit of microwave drying is the fact that the practically non-polar fat molecules have little effect on drying rate and other drying characteristics. As will be shown below, the advantages of microwave drying under vacuum (the objective of this patent) permit not only manufacture of dry hides but also of other marketable products and by-products of value to hide processors and tanners such as fat and undenatured collagen.

To accomplish hide and leather drying with concomitant use of vacuum and microwave energy inside a tanning drum (see FIG. 1 to 3), it is equipped with a modified outer cover or "door" (5) for introducing microwave energy. .An important embodiment of this invention is the design of the additional, modified door replacing the loading door (3*a*). However, to avoid lifting of the modified drum door (5) during loading of hides, a modified additional door may be permanently installed over a separately constructed opening at the top of the outer drum (3). The modified drum door is provided with splash guards (5*a*) that can be closed during wet operations. During drying and solvent recovery all outer doors (3*a*, 3*b*, and 5) are attached securely to the stationary drum to prevent leakage of microwave energy into the outer space surrounding the tanning drum, and to avoid leakage of air into the drum that is under vacuum. Microwave energy, generated by magnetron or microwave generator (9) that is supplied by electricity from power supply (6) is introduced through transmission ducts (8) into the cavity of outer door (5). The cavity is provided with either metallic stirrers (7)) or metallic reflectors (not shown) which create a multimode field in the cavity. The microwaves (10) enter the rotating inner drum through holes in the inner drum where they penetrate the hide and cause the moisture to evaporate from the "inside out". The inner drum is made either from stainless steel with many holes or, preferably constructed from a plastic material that does not absorb microwave energy. The rate of drying is controlled by means of a fiber-optic thermometer that is located inside the drum and connected to a temperature controller recorder (30) outside the drum that determines the amount of power supplied by power supplier (6). Moisture (or solvent) leaving the drum passes along pipe (23) and through valve **(23*a*) into vacuum tank (26) and from there it is sucked in into vacuum pump (27). The exhaust (29) leaves the vacuum pump through valve (28). The pressure in the tanning drum is controlled by means of pressure recorder controller (31)**. A typical drum capacity is 25000 lb. of hide containing 8333 lb. of water. A typical high power magnetron delivers 30 kW at 915 and is capable of evaporating 75 lb. of water per hour. To completely dry the hides in 8 hours, 13 magnetrons are required.

For processing hides in a hide processor (see FIG. 4), it is equipped with a cover door (5) for introducing microwave energy. As in the case of a tanning drum, the door provides a tight closure that permits evacuation of the machine and prevents escape of microwave energy during drying and during solvent evaporation. Microwave energy (10) generated by magnetrons (9) enters the door cavity through transmission ducts (8). Stirrers (7) in the cavity of the cover generate a multimode field and the dispersed radiation (10) enters the hide processor and is absorbed uniformly by the tumbling hides. The door may be constructed to turn with the vessel or be stationary. All conventional operations can be carried out with or without the cover. Vacuum application and moisture removal is identical to the method described above. Loads of 20000 lb. of hides are common for hide processors. About 11 high power magnetrons are needed to dehydrate the hides in 8 hours.

In addition to showing the equipment used during conventional hide salting and leather manufacture described above in section A of this detailed description of the invention (washing, demanuring, salting, unhairing, neutralizing, tanning, etc.), FIGS. 1 to 4 show process flow diagrams of the three additional, independent, consecutive types of processes (embodiments of this invention) that can be carried out in conjunction with a modified tanning machine described in this patent: (a) drying of hides, hide trimmings, or partially defatted fleshings before or after hair removal or even after tanning with concomitant application of microwave energy and vacuum using the novel procedure covered in this patent; (b) defatting the drum contents using solvent extraction; and (c) recovery of the solvent remaining in the product while again utilizing concurrently both vacuum and microwave energy by the new procedure.

C. Processing According to this Invention Using the Modified Tanning Machinery and Ancillary Equipment.

Figure 3:
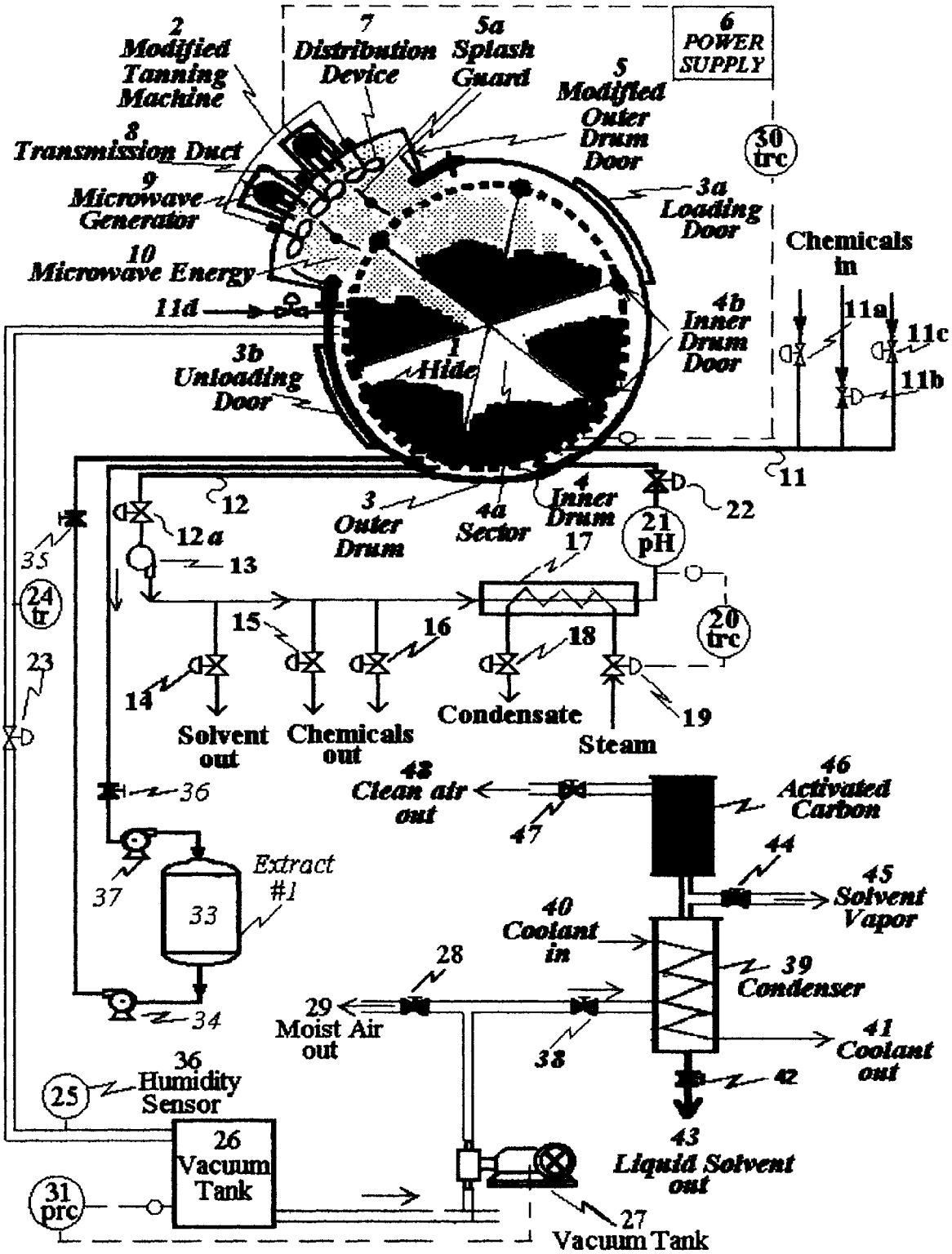
FIG. 3 gives a cross-sectional view of the same tanning drum shown in FIGS. 1 and 2 that has been modified to permit concomitant use of microwave energy and vacuum to remove both moisture and fat from hides and other animal by-products. As in FIG. 2, the modified tanning drum is shown as the basic apparatus in a process flow diagram illustrating the important steps for (a) the conventional operations used in tanneries, (b) dehydrating hides, skins, and animal by-products with microwave energy under vacuum inside the hide processor; (c) solvent extraction of fat and (d) recovery of the solvent retained in the material being defatted utilizing microwave energy and vacuum.

Removal of moisture and removal of solvent by concomitant use of vacuum and microwaves are two processes that are intrinsic embodiments of this invention. Defatting with the help of a solvent and recovery of fat and solvent are two additional essential processes. A detailed description of each of these four important processes that permit manufacture of at least 9 novel products is given below:

(a) Microwave Dehydration—Removing moisture using microwaves and vacuum concurrently:

Drying of hides and other animal products according to this invention either in a drum or a hide processor has to be carried out at a vacuum below 60 mm Hg absolute pressure to avoid collagen denaturation. To remove the moisture generated and to maintain the desired low pressure, the vapor is evacuated through pipe (23) and vacuum tank (26) by means of a two stage dry vacuum pump (27) or another source of vacuum (e. g. steam jets) and exhausted through valve (28) to the atmosphere (29). Pressure recorder controller (31) is used to monitor the pressure in the tanning drum. Temperature controller recorder (30) maintains the desired temperature in the drum by controlling the power supplied to the magnetron. To aid in monitoring the condition of the hides inside the tanning machine a temperature recorder (24) and a humidity sensor (25) may be used. p1 (b) Defatting With A Solvent—Extracting fat from the hide or other animal products with a solvent and decanting of the solution from the tanning machine:

As shown in FIG. 2 ,3 and 4, to accomplish fat removal by solvent extraction according to this patent the solvent is preferably reused at least once and stored in tank (33) having been introduced into it through valve (36) with the help of pump (37). To begin the extraction of the fat with a solvent, extract #1 inside tank (33) is pumped through valve (35) utilizing pump (34) into the tanning machine containing the hides. After tumbling the hides and the solvent for at least 4 hours, the solvent containing the fat (extract #2) is pumped out with the help of pump (13) through valves **(12*a*) and (14). Fat and solvent recovery from this solution is carried out by any of several procedures described in the literature (e. g. Badger, W. L. and Banchero J. T., "Fundamentals of Chemical Engineering", McGraw-Hill Book Co., Inc., New York (1955), p. 331). Fresh solvent is then introduced into the drum through valve (11*c*) and the fat extraction procedure is repeated for another 4 hours or more after which the solution is introduced into tank (33)** for later reuse.

(c) Recovery Of Fat And Solvent:

As mentioned above, separation of these two materials present in extract #2 may be readily accomplished using any of several processes published in the literature (e. g. Badger and Banchero, see above).

(d) Solvent Recovery Using Microwaves—Boiling off of the solvent retained in the hide after decantation of the fat-in-solvent solution using concurrently microwaves and vacuum:

According to this invention the solvent remaining in the hide after fat extraction is also recovered using microwave energy and vacuum concurrently. To accomplish that, the preliminary drying operation is identical to that described in section C(a), i. e. part a of section C of this description of the invention. Drying is interrupted when a moisture content of about 36% is reached. The low moisture content renders the hide more hydrophobic and thus facilitates the penetration of the solvent into the hide and extraction of the fat from the hide. After the fat is extracted and the solution containing the fat is decanted, a considerable amount of solvent remains in the hide along with the 36% of water. To remove them, the tanning machine is evacuated to 60 mm Hg and microwave energy is introduced as during the drying step described in section C(a). The dipolar water molecules that remained in the hide after the solution was decanted absorb the microwave energy needed to heat the hide sufficiently to cause the hexane to boil at 5.4° C. and not the water the boiling point of which at 60 mm Hg is 41.7° C. All the energy is absorbed by the water and transferred to the solvent. After the solvent has been removed, the temperature in the hide is permitted to rise to 41.7° C. and moisture is removed from the hide. As seen from FIG. 2, pressure recorder controller (31) is used to monitor the vacuum in the drum (at below 60 mm Hg absolute pressure) and temperature recorder controller (30) is used to maintain the desired temperature in the tanning machine (preferably below about 32° C. during solvent evaporation). The solvent vapor travels through valve (23*a*) and vacuum tank (26) into vacuum pump (27) and whence is discharged through valve (38) into condenser (39). The condensed solvent (43) is reused. Any traces of the solvent present in the air leaving the condenser may be removed by passing the gas mixture through valve (44) into the plant boiler house for incineration or by passing the mixture through a bed of activated carbon (46) and exhausted as clean air (48) through valve (47).

(D) New Products Manufactured by Processing Proposed in this Invention.

Figure 5:
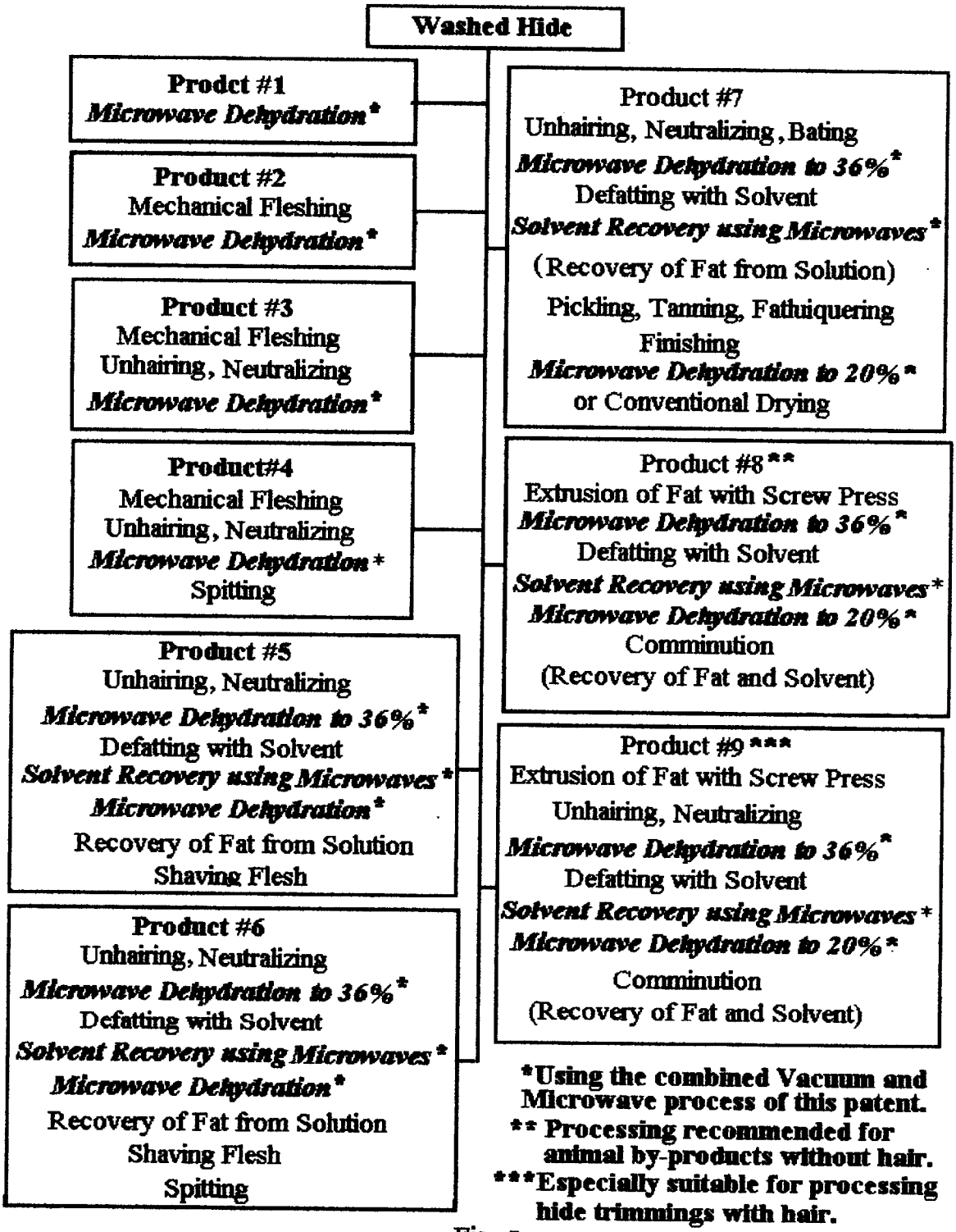
FIG. 5 is a block diagram showing 9 typical products that can be produced when vacuum and microwave energy are used concurrently (a) to dehydrate hides at different stages of leather manufacture or (b) to dehydrate hides, hide trimmings, and other animal by-products to extract fat from them, and to recover the solvent retained in them.

The main processing steps required to obtain 9 different products can be gleaned from FIG. 1 to 4 and are described above in sections C(a) to C(d) of this patent ("Description of the Preferred Embodiments of the Invention") and summarized in FIG. 5. More products can be envisioned by somebody familiar with hide and leather processing. Manufacture of these 9 different novel products are also important embodiments of this invention.

Preservation of hides by dehydration using combined vacuum and microwave energy requires primarily the addition of a modified outer drum door (5), a vacuum pump (27), and the other ancillary equipment described above (and shown in FIG. 1 to 4) to a tanning machine presently used commercially to salt hides or to manufacture leather. Furthermore, by applying mild drying conditions (achievable by concomitant use of vacuum and microwave energy) to hides at different processing steps of the conventional leather manufacturing process, different hide and leather products are obtained. By using hide trimmings and other animal by-products, comminuted collagen is obtained in addition to fat. FIG. 5 summarizes the manufacturing procedures used and the different new products obtainable to satisfy different demands of the world market. The quality of the products and the manufacturing costs depend to a great extent on whether the combined microwave and vacuum drying process of this invention is used for removal of only moisture or both moisture and solvent.

Drying inside the rotating tanning machine may be carried out by employing the combined microwave and vacuum drying (a) after washing, (b) after washing, demanuring and mechanical fleshing, (c) after washing, demanuring and solvent extraction of fat, (d) after washing, demanuring, unhairing, and solvent extraction of fat, or (e) postponed until after coloring and fatliquoring to yield "crust" leather.

Product #1, FIG. 5 is obtained by drying after washing of the hide; product #2 is obtained by drying after mechanical fleshing following washing and demanuring; and product #3 is obtained by drying after washing, mechanical fleshing, unhairing and neutralizing. Products #1 and #2 have the advantage that they are simpler and cheaper to manufacture and that they are most similar to the salted hides presently on the market. An unhaired hide (product #3) has the desirable feature that it can be better graded for grain defects. Furthermore, such hides are soft and pliable and can be split as accurately as chrome tanned crust leather; consequently, product #4 is obtained by splitting product #3. Splitting of the dry hides before tanning has many advantages. For example, tanning of the splits is less time consuming and chrome distribution is more uniform throughout the hide thickness. The disadvantage of manufacturing dry hide products #2, #3 and #4 is the manual labor connected with mechanical fleshing.

Product #5 is obtained while avoiding the labor intensive operating step of mechanical fleshing. As explained above, the hides are unhaired, neutralized and then dried to 36% moisture content (using the processing steps detailed in section C(a) of this patent) to render it hydrophobic enough to allow the solvent, hexane being a preferred candidate, to penetrate into the hide and defat the hide as well as the subcutaneous tissues on the flesh side of it (see section C(b) for details). The solution containing the extracted fat is drained from the tanning machine, the fat is separated from the solvent by evaporation, and the solvent is recovered for reuse by condensation using known commercial procedures (see section C(c) above for details). The solvent remaining in the hide is then boiled off using the combined vacuum and microwave processing steps of this invention (see section C(d) above) and the hide is finish dried to about 20% moisture content after the last traces of the solvent have left the hide at the low temperatures of this process (see section C(a).

Product #5 which avoids mechanical fleshing of washed hides can be processed further yielding product #6 which is mechanically split yielding a grain layer and a flesh layer. As in the case of product #4, there are many advantages in splitting the dry hides before tanning. To conduct very accurate splitting of the dry hides, the subcutaneous tissues on the flesh side of the hide containing mostly collagen are first removed mechanically preferably by shaving to yield a dry hide of uniform thickness as well as a dry comminuted, valuable and salable collagen by-product. If shaving is carried out properly, splitting of the hide is simple and most accurate. The grain split is of greatest value to the tanner. The chrome-free flesh splits as well as the shavings can be sold not only to tanners but also to other users of collagen such as manufacturers of sausage casings.

Manufacture of product #7 allows a tanner to reduce manual labor to a minimum by carrying out all processing steps used to manufacture leather without removing the hide from the tanning machine. To accomplish that, the tanner carries out the concomitant vacuum and microwave processing in three consecutive steps. First after unhairing and neutralizing to reduce the hide moisture content down to 36% to permit hexane to penetrate the hide (see section C(a)), then to evaporate the solvent remaining in the hide after fat extraction (see section C(c)), and finally either after tanning or after fatliquoring to dry the leather down to about 20% moisture content (see section C(a)). Products #1 to #7 are of particular importance to the hide and to the leather business.

The procedure used to manufacture product #8 is primarily useful for processing animal by-products containing fat such as mammary glands and hide fleshings that contain a rather high fat content but no hair. The main manufacturing steps involve (a) extrusion of the major amount of fat with a screw press, (b) dehydration to 36% moisture content (see section C(a)), (c) defatting by means of a solvent (see section C(b)), (d)solvent recovery (see sections C(c) and C(d)), (e) dehydration to about 20% moisture content (see section C(a)) and (f)comminution.

To obtain product #9, the procedures used to manufacture products #6 and #8 are adapted to treating the presently uneconomically utilized by-products containing fat and hair. As in the manufacture of product #8, the materials are first partially mechanically defatted using a screw press like the desinewing-deboning machine used in the meat industry. The solids that do not pass through the screen of the screw press are then unhaired, washed, neutralized, treated further like product #5, and finally comminuted. The procedure used to manufacture product #9 should be of great value for treating hide trimmings and other offal containing hair that usually are landfilled. Hide trimmings are presently a major solid waste problem while undenatured collagen is in short supply. Treating trimmings as described here would solve both predicaments.

E. Detailed Description of the Manufacture of Typical Products

The following nonlimiting examples of operating procedures for different initial and end products are intended to further elucidate the invention. The processing steps required to obtain the required results can be gleaned from FIG. 1 to 4 and are described above in processes C(a) to C(d) of section C of this part of the patent ("Description of the Preferred Embodiments of the Invention") and summarized in FIG. 5.

(a) Drying Of Hides To Obtain Hide Product #1—Processing Limited To Drying.

Most of the hides on the world market have both hair and flesh on them. Unlike during conventional drying at atmospheric pressure, during vacuum drying with microwaves, the presence of the non-polar fat in adipose and subcutaneous tissues has very little effect on the drying characteristics of hides and the hide collagen remains undenatured. Consequently, a greatly improved product containing both hair and fat can be marketed by limiting the operations to washing and drying using the procedure recommended in this patent (see FIG. 1) and described above in section C(a). Because water evaporation occurs inside the hide and capillary forces are minimal, the dry hides are soft and flexible and can be sold as is, or preferably fleshed or shaved to remove the flesh, to recover fat, and to prevent fat from traveling into the hide during storage.

To ensure high hide quality, the hides are brought in from the slaughter house as soon as possible and loaded by conveyor belt into a tanning machine such as a drum divided into sectors (see FIG. 1) or a hide processor (see FIG. 4). During loading of hides the modified outer door (5) is raised unless a separate modified door has been installed. All doors are than closed and the hides are washed (with the machine running) to remove blood, dirt and manure by introducing water through valve (11*a*) while valve (11*d*) is open. For all wet operations the splash guard (5*a*) in the modified outer drum door (5) is also closed. Valves (12*a*), (22), and (11*d*) are opened and valves (14), (15) and (16) are closed while some water is recycled by means of pump (13) through heat exchanger (17). To maintain the desired temperature in the tanning machine, temperature recorder controller (20) is used to control the amount of steam passing through valves (18) and (19). After running the tanning machine for a sufficient length of time the waste water is thoroughly drained from the tanning machine by opening valve (15).

To commence drying, all of the valves leading into the tanning machine are closed, the modified outer door (5) is installed (if it was removed during loading of hides), the splash guard (5*a*) opened in the case of permanently installed doors, valves (23*a*) and 28 are opened and vacuum pump (27) is started. The air is drawn into pipe (23) and vacuum tank (26) and is exhausted to the outside (29) through valve (28). After the required degree of vacuum is reached, microwave energy (10) is applied by means of power supply (6), microwave generator (9), microwave transmission duct (8), and channeling devices (7). The recommended vacuum is at or below 60 mm Hg to ensure a temperature below 42° C. in the drying chamber in order to prevent denaturation of collagen. Slightly higher temperatures (up to about 60° C.) at higher pressures are permissible but preferably only after lower moisture contents in the hides have been reached. The desired drying temperature in the hides is achieved using recorder controller (30). Pressure recorder controller (31) ensures the required vacuum in the drying chamber (below 60 mm Hg absolute pressure). Additional monitoring of the drying process is furnished by temperature recorder (24) and humidity sensor (25). Drying is discontinued when the hides have reached a moisture content of about 20%. The energy input is stopped and the pressure increased to atmospheric conditions by introducing air through valve (11*d*). One disadvantage of this process is the fact that with the hair on, the hides may not be split.

To manufacture product #2, the hide is prefleshed before it is processed identically to product #1. Presently, most of the hides are washed to remove blood, dirt and manure in a tunnel washer. This is conventionally followed by mechanical demanuring and fleshing to remove subcutaneous tissue. If it is desirable to retain this practice (because recovery of fat pays for the fleshing operation), it is still preferable to preserve the hides by drying using the method recommended in this patent instead of salting them. This approach is prudent because in the proposed process the fleshings can be later defatted first mechanically (using a screw press) and then with the help of a solvent to yield two expensive marketable products: undenatured collagen and fat (see manufacture of Product #8 below).

(b) Manufacture Of Product #6—Unhairing And Defatting Conducted Inside Tanning Machine Before Drying.

To unhair the hides, they are first washed employing the procedure used during manufacture of product #1. Depending on the quality of fat desired, lime and sulfide or dimethylamine sulfate are then added through valve (11*b*) into the tanning machine (hide processor or drum) containing the washed hides. As during washing, valves (12*a*), (22) and (11*d*) remain open and valves (14), (15) and (16) are closed while the tanning machine is run for a sufficient amount of time to dissolve the hair. The time required depends on the concentration of the unhairing chemical used as described in the literature. To control the operation the solution is recycled through heat exchanger (17) by means of pump (13). Temperature adjustments are made with the help of temperature recorder controller (20) which controls the amount of steam passing through valves (13) and (14). The pH is monitored by means of the in-line pH meter (21).

At the end of the unhairing operation, the unhairing solution is decanted by opening valve (15) with pump (13) running and valve (22) closed. The hides are then washed by introducing fresh water to the drum either continuously or in batches through valve (11*a*) and dumping it through valve (15). Finally, the hide pH is adjusted to about 9 or below by adding a neutralizing solution (such as ammonium sulfate) to the tanning machine, running it and adding additional amounts of the neutralizing agent until the desired pH is reached. All these operations may be automatically controlled. The equipment and procedures used are amply described in the literature. Also, addition of water and chemicals varies in the industry with the type of tanning machine used as well as among machines of the same type. The type of chemical used for dehairing depends on the quality of fat desired. Sulfide would be used if the quality of fat recovered does not have to be of high. Unhairing would preferably be accomplished using dimethylamine sulfate if fat of better quality is to be obtained. The latter chemical has been used in the past for many years in the American leather industry until it was discovered that it forms carcinogenic nitrosamines in the presence of nitrous gases (developed in combustion processes such as by gasoline driven forklift trucks in the tannery). In the process envisioned in this patent all operations would be carried out in the absence of nitrous gases in the same tanning machine located in a separate fully enclosed solvent processing facility. After being thoroughly washed to remove the chemicals used for unhairing, and neutralized to a pH below about 9, the hides are dried to below about 36% moisture content by the method described in this patent utilizing vacuum and microwave energy and described above in section C(a) and in the manufacture of product #1 above. After a hide moisture content of about 36% has been reached (and the hide is sufficiently hydrophobic) the energy input is stopped, valve (23*a*) is closed and the pressure increased to atmospheric conditions preferably by introducing nitrogen through valve (11*d*).

Fat is removed from the subcutaneous tissues of the hide using procedure C(b): Solvent from the preceding run is introduced from storage tank (33) through valve (35) to the partially dried hides by means of pump (34). After a minimum of 4 hours of running, the drum is emptied through valve (14) with the help of pump (13). The pressure is raised to atmospheric conditions by introducing nitrogen through valve (11*d*). Separation of fat and solvent from extract #2 can be accomplished using one of many published procedures (see section C(c)). Fresh solvent is then introduced and the solvent extraction repeated. The solution from this second extraction is then decanted and stored as extract #1 in tank (33) for later reuse having been pumped there through valve (36) with pump (37). For solvent extraction, hexane or a similar low boiling solvent, is used at atmospheric pressure and temperatures not exceeding 42° C. to avoid damage to the hide collagen. During solvent extraction, drumming should be continuous for about 4 hours to permit diffusion of the solvent into the hide, and fat out of the hide and into the solution. The speed of the drum should be adjusted to provide the maximum of mechanical action to the hides. This is achieved when the centripetal force on the hides is equal to the centrifugal force. As a general guide a drum 8 feet in diameter would be run at 11 rpm.

The solvent that remains absorbed in the hide is removed from the hide by application of vacuum and microwave energy as explained in Section C(d): To commence solvent removal, valve (23*a*) is opened, cover (5) is installed and all the other valves leading into the drum are closed, vacuum pump (27) is started, valve (28) is opened and the solvent is evacuated passing through valves (23*a*), vacuum tank (26), and finally exhausted through valve (38) into the condenser (39) where the solvent is condensed along with a small amount of water which can be readily separated from the solvent by gravity separation. After the required degree of vacuum is reached, microwave energy is applied to the hides by means of microwave generator (9), microwave transmission ducts (8), and channeling devices (7). The recommended vacuum in the tanning machine is at or below 60 mm Hg and the temperature considerably below 42° C. to prevent premature evaporation of water. The solvent removal progress may be monitored by means of thermometer (24), although pressure regulator and controller (31) and temperature regulator and controller (30) provide sufficient means for controlling the operation. If the solvent used is hexane, it will boil at 5.4° C. After the hexane has been boiled off, a rise in temperature is observed as water itself begins to absorb all of the energy. At this time the temperature in the tanning machine rises to 42° C. as the hide moisture is being reduced to about 20%. Finally, the dry hides are unloaded through drum cover (Sa) and shaved prior to palleting and marketing. In the absence of fat, the subcutaneous tissues consist mostly of connective tissue collagen material that can be readily shaved off and used in many industrial and medical applications. The hide may also be accurately split after shaving to market the flesh split as a source of undenatured collagen devoid of most of the fat. Shaving and palleting of the dry hides is very readily carried out because the hides are relatively light and flexible. Having not been exposed to high temperature, the fat from the fleshings is of good quality if unhairing was conducted using a non-smelling chemical such as dimethylamine sulfate.

Because they are dry, the hides store well. Being lighter they may be shipped at a lower cost. And because of the drying process used, the hides are porous and flexible and, therefore, rehydrate well in the tannery. Furthermore, the hides can be readily split by the tanner to the desired thickness as accurately as leather. Manufacture of product #6 has the capability to reduce the potentially hazardous, chrome containing solid tannery wastes now generated by tanners that are forced to shave and split chrome tanned hides. Dried hides are susceptible to insect attack, however. To protect them they may be sprayed, covered with an appropriate dusting powder or preferably placed in plastic bags if long storage periods are anticipated.

(c) Manufacture Of Product #8 From Fleshings.

As mentioned at the end of section (D) above, fleshings and other animal tissues containing no hair are first passed through a desinewing-deboning screw press to screen out most of the fat. The collagen materials that do not pass through the screen are processed further like product #6 above except that unhairing is omitted and the dry product is comminuted to increase its value.

(d) Manufacture Of Product #9 From Trimmings.

Trimmings and other animal products containing hair or bones are also first passed through a screw press to remove most of the fat. The collagen materials that do not pass through the screen are then treated exactly like product #5 above because they contain hair. Like product #8, the dry, unhaired product obtained may be comminuted to increase its worth.

During manufacture of Products #8 and #9 it may be easier to carry out the comminution in the wet condition (see Komanowsky, M. et al., Journal of the American Leather Chemists Association, vol. 85, p. 131–141 (1974) in which case the animal by-products would be removed from the tanning machine, comminuted, and returned to the tanning machine in the form of a thick slurry for final drying under conditions described in this patent. To avoid cohesion of the fine particles during drying, metal balls covered with plastic would be introduced into the tanning machine.

Other variations and modifications of the invention as described are possible and obvious to one of ordinary skill in the art of hide processing, tanning or drying. They are intended to be included in the scope of the inventions as defined by the following claims.

What is claimed is:

1. A process aimed at replacing salting to preserve hides, skins and other animal by-products and producing undenatured, dry collagen, comprising:

(a) drying said animal by-products with concomitant application of microwaves and vacuum to moisture contents low enough to ensure long storage stability while using temperatures low enough to prevent collagen denaturation, (b) providing means for turning over and mixing during drying of said by-products to (1) expose them to microwave energy in such a way as to achieve uniform distribution of moisture during drying in all parts of said by-products, (2) reduce drying time, (3) obtain a soft, pliable, product that can be readily shaved, split, and rehydrated, (c) processing said by-products inside said processing means to carry out unhairing or extraction of fat.

2. A process for obtaining fat-free, dry undenatured collagen and high quality fat from animal by-products, comprising:

(a) preliminary drying of said by-products by the method and means described in claim 1 to a moisture content at which solvents readily penetrate the by-products, (b) in situ extracting fat from the said by-products with a solvent utilizing thorough mixing of the two materials to expedite the extraction process, (c) removing the solvent and fat mixture for fat recovery in separate equipment by distillation obtaining a fat product of high quality and recovering the solvent for reuse, (d) removing the remaining solvent from the by-products by the method and means described in claim 1 keeping the vacuum and temperature low enough to prevent collagen denaturation and below the boiling point of water but above the boiling point of the solvent to boil it off, (e) recovering the solvent in separate equipment by condensation, (f) after solvent removal, finishing dehydration of the said by-product by the methods and means described in claim 1 obtaining a fat-free, valuable, undenatured collagen product at a moisture content low enough to ensure long storage life.

* * * * *